United States Patent [19]

Selby

[11] Patent Number: 4,841,631

[45] Date of Patent: Jun. 27, 1989

[54] CABLE SUPPORTING APPARATUS

[75] Inventor: John A. Selby, Wokingham, England

[73] Assignee: Thomas & Betts Corporation, Bridgewater, N.J.

[21] Appl. No.: 43,667

[22] Filed: Apr. 28, 1987

[30] Foreign Application Priority Data

Apr. 28, 1986 [GB] United Kingdom ..... 8610322

[51] Int. Cl.[4] ..... H01R 43/04

[52] U.S. Cl. ..... 29/749; 29/753; 29/759

[58] Field of Search ..... 29/749, 759, 753, 564.1, 29/564.6, 564.8

[56] References Cited

U.S. PATENT DOCUMENTS

| | | | |
|---|---|---|---|
| 4,245,387 | 1/1981 | Reidt | 29/749 |
| 4,554,733 | 11/1985 | Caveney | 29/749 |
| 4,580,340 | 4/1986 | Shields | 29/749 X |
| 4,729,152 | 3/1988 | Hammond et al. | 29/749 X |

FOREIGN PATENT DOCUMENTS

| | | |
|---|---|---|
| 0007681 | 2/1980 | European Pat. Off. . |
| 0182528 | 5/1986 | European Pat. Off. . |
| 1293594 | 4/1969 | Fed. Rep. of Germany . |
| 1604957 | 5/1978 | United Kingdom . |

*Primary Examiner*—Carl E. Hall

*Attorney, Agent, or Firm*—Robert M. Rodrick; Salvatore J. Abbruzzese

[57] ABSTRACT

Cable supporting apparatus for assembly machines for terminating electrical cable with connectors includes a base and cable support means mounted on the base for supporting a length of cable. The support means is movable relative to the base from a cable loading position, in which position the support means is spaced from the machine connector applicator, to a working position, in which the support means presents a cable to the applicator for termination with a connector. The support means includes a plurality of cable support elements selectively positionable thereon. In addition, a sensor is provided for sensing when the support means is in the cable loading position.

9 Claims, 2 Drawing Sheets

CABLE SUPPORTING APPARATUS

FIELD OF THE INVENTION

The invention relates to apparatus for supporting cable and for presenting cable to apparatus for terminating the cable with a connector. The term "cable" used herein includes cable, wire or wires and the invention relates more particularly but not exclusively to termination of flat cable.

BACKGROUND OF THE INVENTION

Machines for automatically or semi-automatically assembly of electrical connectors to electrical cable or wires are known. Current machines often require the operator to position the cable or wires manually into the termination area, such positioning involving a substantial amount of operator dexterity. As a result, speed of operation is reduced and risk of making poor quality connections is increased. Accordingly, it is desirable to overcome these operational difficulties making it easier and faster to provide satisfactory connections.

SUMMARY OF THE INVENTION

According to a first aspect of the invention, there is provided apparatus for supporting cable and for presenting cable to connector applying means, which apparatus comprises a base and cable support means mounted on the base for supporting a length of cable, said cable support means being movable relative to said base from a cable loading position, in which cable loading position, in use, said cable support means is spaced from said connector applying means, and a working position, in which working position, in use, cable supported on said cable support means is presented to said connector applying means for application of connector means to said cable, wherein said cable support means comprises a plurality of cable support elements selectively positionable thereon.

According to a further aspect of the invention, there is provided apparatus for supporting cable and for presenting cable to connector applying means, which apparatus comprises a base and cable support means mounted on the base for supporting a length of cable, said cable support means being movable relative to said base from a cable loading position, in which cable loading position, in use, said cable support means is spaced from said connector applying means, and a working position in which working position, in use, cable supported on said cable support means is presented to said connector applying means for application of connector means to said cable, there being sensor means for sensing when said cable support means is in said cable loading position.

The cable support means preferably comprises an elongate member on which member the cable support elements are selectively positionable.

The apparatus preferably comprises means for controlling movement of the elongate member such that cable support on the cable support elements extends normal to the direction of movement of the elongate member.

The elongate member is preferably supported at least at each end thereof on arm means extending in the direction of movement of the elongate member, and said movement controlling means preferably comprises roller means in engagement with the arm means, the roller means being fixed for rotation one with another, whereby unit movement of one arm means will result in unit movement of the or each other arm means.

The arm means may be in frictional engagement with the or each roller means.

Each roller means may comprise a pair of spaced apart rollers and belt means extending around the rollers, the rollers and the belt means lying beneath the associated arm means, there being means above the arm means for maintaining each arm means in contact with the associated belt.

BRIEF DESCRIPTION OF THE DRAWINGS

By way of example, one embodiment of apparatus according to the invention will now be described with reference to the accompanying drawings, in which.

DETAILED DESCRIPTION OF THE PREFERRED EMBODIMENT

Figure 1:
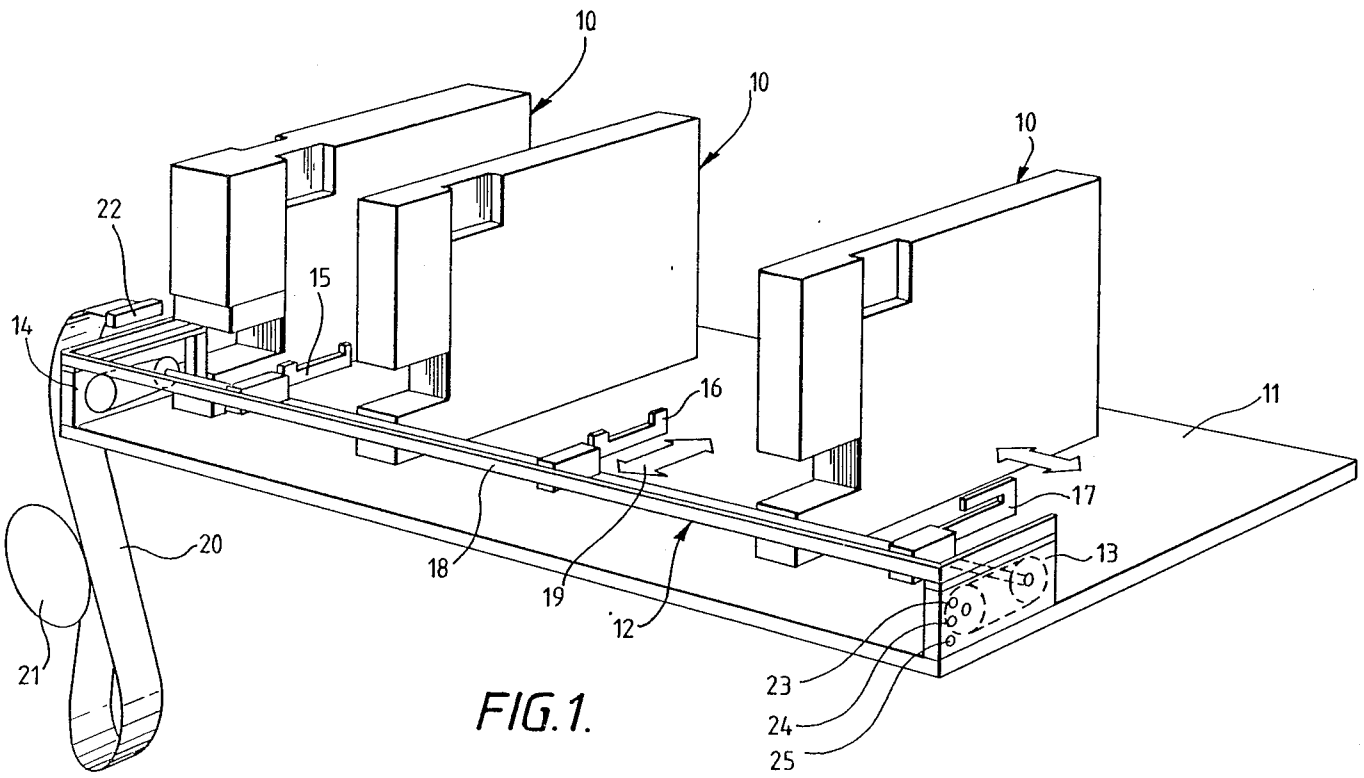
FIG. 1 is a general perspective view showing apparatus according to the invention.

FIG. 1 shows schematically a typical arrangement for cable termination involving three assembly machines 10 for terminating cable with connectors. The machines 10 are located on a base 11, on which base 11 is mounted a cable support frame 12.

The support frame 12 is movably mounted on end support assemblies 13, 14 fixed relative to the base 11, the frame 12 in turn having mounted on it cable support elements 15, 16 and 17. The cable support elements 15, 16 and 17 are selectively positionable along an elongate bar 18 of the frame 12 such that they may occupy whatever positions are most convenient for supporting cable to be terminated. It will be appreciated that more than three or indeed less than three cable support elements may be present at any one time.

The mounting arrangement of the frame 12 on the support assemblies 13 and 14 will be described in more detail with reference to FIG. 2 but the arrangement is such that movement of the frame 12 towards and away from the assembly machines 10 is in a direction perpendicular to the longitudinal axis of the elongate bar 18, the movement being illustrated by arrow 19 in FIG. 1. The frame 12 is movable from a cable loading position (as shown in FIG. 1) in which the cable support elements 15, 16 and 17 are remote from the working area of the assembly machines to a working position where cable supported on the cable support elements are presented to the assembly machines 10.

In use, cable, in the illustrated embodiment flat cable 20, is drawn by an operator from a reel 21 along the length of the elongate bar 18 over the cable support elements 15 and 16. The cable 20 has a stop block 22 at its free end and the stop block 22 is engaged behind the face of the slotted cable support element 17. The operator maintains the cable 20 in slight tension against the cable support element 17 to keep the cable level along the length of the bar 18. A short loop in the cable is present between the reel 21 and the cable support elements to allow for relative movement between the static reel 21 and the frame 12.

In order to indicate to an operator when the frame 12 is in the cable loading position, a sensor (to be described in detail with reference to FIG. 2) is provided with, for example, an indicator, either visual or audible, that the frame is in the cable loading position. A further sensor (again to be described in detail with reference to FIG. 2) is provided for detecting when the frame 12 is fully and correctly located into the assembly area of each machine. When in the working position, the assembly machines are operated to apply connectors to the cable 20. The central and right hand assembly machines 10 in FIG. 1 both apply a single connector to the cable 20 but the left hand machine 10 (which can be seen is larger than the other two) applies two connectors and also includes a central cable cutter so that the cable 20 is cut and the ends of the cable 20 at the cut are both terminated with a connector. In this way, the free end of the cable 20 is left with a connector 22 at the end of each operating cycle.

It will be appreciated that while the apparatus can be used with manual operation, the sensors for sensing when the frame is in the cable loading position or in the working position are preferably used to initiate an automatic assembly operation. Thus when the assembly machines sense position of the cable in the working position, the assembly operation of the connectors can be started automatically. To provide added control flexibility, three operator control buttons 23, 24 and 25 are located on the end support assembly 13. If the operator presses button 23, the right hand machine 10 only will apply a connector, and the cable 20 will not be cut. If the button 24 is pressed, the two right hand assembly machines 10 will operate when the working position is reached, and if button 25 is pressed, all three machines 10 will operate when the working position is reached. This allows great flexibility in where connectors are applied, and when the cable is cut by the left hand machine 10. It will be appreciated that the control permutations could be altered very easily from the arrangement just described.

Likewise, withdrawal of the frame 12 from the assembly macines to the cable loading position can trigger the sensing devices to initiate automatic reloading of parts in the working area of each assembly machine 10 in readiness for the next cycle of operation. It is possible to power drive the movement of the frame 12 and the drawing of the cable along the frame in a more automated version of the equipment than is illustrated here.

Figure 2:
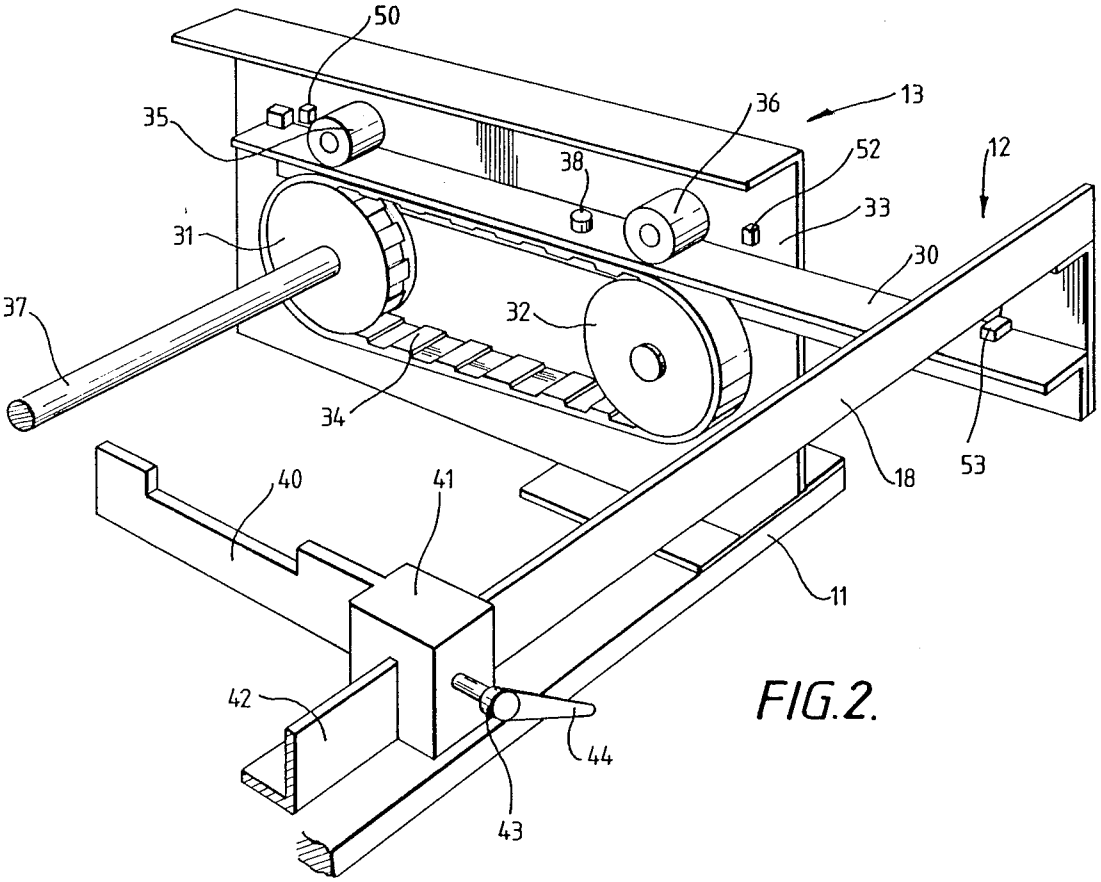
FIG. 2 is a perspective view showing in more detail a movable frame of the apparatus and a cable support mounted thereon.

Turning to FIG. 2, there is shown in detail how the frame 12 is mounted on the end support assemblies 13 and 14, how a cable support element is mounted on the bar 18 and the sensing device arrangement.

The frame 12 includes a pair of arms, one of which is illustrated at 30, extending forwardly over the bar 18. The arm 30 is of angle section and, similarly to the bar 18, is conveniently of metal. The arm 30 is supported on a roller assembly consisting of a pair of lower rollers 31 and 32 rotatably mounted on a plate 33 of the end support assembly 13. The rollers 31 and 32 are rotationally linked by a ribbed drive belt 34 engaging correspondingly profiled outer surfaces of the rollers 31, 32.

To ensure that the arm 30 moves with the belt 34, a bolt 38 secures the arm 30 and belt 38 together, and to keep the arm 30 level, upper rollers 35, 36 are provided, the rollers 35 and 36 being rotatably mounted on the plate 33. As an alternative, the arm 30 may be frictionally engaged with the belt 34 such that rectilinear movement of the arm 30 is translated into rotational movement of the rollers 31 and 32.

The roller 31 is fixed for rotation with a corresponding roller of the end support assembly 14 by means of a shaft 37. It will be appreciated that the assemblies 13 and 14 ensure that the bar 18, whatever its spacing from the assembly machines 10, lies normal to its direction of travel.

FIG. 2 also illustrates a cable support element 40 similar to the cable support elements 15 and 16 in FIG. 1. The cable support element 40 includes an engagement block 41 slotted to engage over a vertical portion 42 of the bar 18. Threadedly engaged in the block 41 is a clamping element 43 rotatable by means of a handle 44. The cable support element 40 can thus be slid along the bar 18 until a desired position is reached and the clamping element 43 then screwed in to clamp the block 41 against the bar 18.

It will be appreciated that the design of the bar 18 is such as to allow a variety of types and numbers of cable support elements and location units for the cable.

The sensor arrangement is also shown in FIG. 2. The cable loading position is sensed by a microswitch 50 mounted on the plate 33 and a block 51 mounted on the arm 30. Contact between the block 51 and the microswitch 50 triggers the microswitch 50 to control whatever operation is desired, or to cause a change of state in an indicator (not shown). In a similar way, the working position is sensed by a microswitch 52 mounted on the plate 33 and a block 53 mounted on the arm 30. Contact between the block 53 and the microswitch 52 triggers the microswitch 52 to initiate operation of the assembly machine or machines 10, or another desired operation or indicator. It will be appreciated that the sensor arrangement may differ from that just described, and that, for simplicity, electrical connections from the microswitches 50 and 52 have not been shown.

The advantage of this apparatus is that it offers a simple means of presenting cable, wire or wires (it will be appreciated that any sort of wire or cable may be terminated using the apparatus) in an orderly and precise manner to machines designed to assemble connectors and or terminals to the cable, wire or wires. The apparatus ensures precise alignment of positioning of the cable, wire or wires with the mechanisms of the machines for assembling the connectors or terminals to the cable, wire or wires in semi-automatic or operator attended methods of assembly. Where operator controlled, minimal dexterity is required and precise positioning and alignment of the parts to be assembled is insured, hence providing significantly lower risk of unsatisfactory connections and providing a higher speed of operation.

It will be appreciated that the foregoing description has been by way of example only and that modifications and alterations may be made within the scope of the invention. The true scope of the invention is set forth in the claims appended hereto.

I claim:

1. Apparatus for supporting cable and for presenting cable to connector applying means, which apparatus comprises a base and cable support means mounted on the base for supporting a length of cable, said cable support means being movable relative to said base from a cable loading position, in which cable loading position, in use, said cable support means is spaced from said connector applying means, and a working position, in which working position, in use, cable supported on said cable support means is presented to said connector applying means for application of connector means to said cable, wherein said cable support means comprises a plurality of cable support elements selectively positionable thereon and an elongate member on which member said cable support elements are selectively positionable;

said apparatus further comprising means for controlling movement of said elongate member such that a cable supported on said cable support elements extends normal to the direction of movement of said elongate member, wherein said elongate member is supported at least at each end thereof on arm means extending in the direction of movement of the elongate member, and said movement controlling means comprises roller means in engagement with each said arm means, the roller means being fixed for rotation one with another, whereby unit movement of one arm means will result in unit movement of the other arm means.

2. Apparatus as claimed in claim 1 wherein the arm means is in frictional engagement with said roller means.

3. Apparatus as claimed in claim 2, wherein each roller means comprises a pair of spaced apart rollers and belt means extending around said rollers, said rollers and said belt means lying beneath the associated arm means, there being means above the arm means for maintaining each arm means in contact with the associated belt.

4. Apparatus as claimed in claim 1 wherein the cable is flat cable.

5. Apparatus as claimed in claim 1 further comprising sensor means for sensing when said cable support means is in said working position or said cable loading position.

6. Apparatus for supporting cable and for presenting cable to connector applying means, which apparatus comprises a base and cable support means mounted on the base for supporting a length of cable, said cable support means being movable relative to said base from a cable loading position, in which cable loading position, in use, said cable support means is spaced from said connector applying means, and a working position in which working position, in use, cable supported on said cable support means is presented to said connector applying means for application of connector means to said cable, there being sensor means for sensing when said cable support means is in said cable loading position, wherein said cable support means comprises a plurality of cable support elements selectively positionable thereon and an elongate member on which member said cable support elements are selectively positionable;

said apparatus further comprising means for controlling movement of said elongate member such that a cable supported on said cable support elements extend normal to the direction of movement of said elongate member, wherein said elongate member is supported at least at each end thereof on arm means extending in the direction of movement of the elongate member, and said movement controlling means comprises roller means in engagement with each said arm means, the roller means being fixed for rotation one with another, whereby unit movement of one arm means will result in unit movement of the other arm means.

7. Apparatus as claimed in claim 6, wherein the cable is flat cable and wherein said arm means is in frictional engagement with said roller means.

8. Apparatus as claimed in claim 7 wherein each roller means comprises a pair of spaced apart rollers and belt means extending around said rollers, said rollers and said belt means lying beneath the associated arm means, there being means above the arm means for maintaining each arm means in contact with the associated belt.

9. Apparatus as claimed in claim 6 further comprising sensor means for sensing when said cable support means is in said working position.

* * * * *